US008353412B2

(12) United States Patent
Rosenbauer et al.

(10) Patent No.: US 8,353,412 B2
(45) Date of Patent: Jan. 15, 2013

(54) INSERT FOR A DISH BASKET FOR AN AUTOMATIC DISHWASHER

(75) Inventors: Michael Georg Rosenbauer, Reimlingen (DE); Ulrich Deiss, Sontheim (DE); Gerhard Fetzer, Gundelfingen (DE); Heinz Heiβler, Dillingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/490,490

(22) Filed: Jun. 7, 2012

(65) Prior Publication Data

US 2012/0241394 A1 Sep. 27, 2012

Related U.S. Application Data

(63) Continuation of application No. 10/437,548, filed on May 13, 2003, now abandoned, which is a continuation of application No. PCT/EP01/13000, filed on Nov. 9, 2001.

(30) Foreign Application Priority Data

Nov. 15, 2000 (DE) ..... 100 564 88

(51) Int. Cl.
*A47G 19/08* (2006.01)

(52) U.S. Cl. ..... 211/41.9

(58) Field of Classification Search ..... 211/41.9, 211/181.1, 41.3, 41.4, 10, 85.31, 85.25, 133.5, 211/41.8; D32/3, 55–59; D6/462, 566; 220/485–488, 495
See application file for complete search history.

(56) References Cited

U.S. PATENT DOCUMENTS

| | | | |
|---|---|---|---|
| 415,634 | A | 11/1889 | Guptill |
| 551,059 | A | 12/1895 | Stone |
| 934,721 | A | 9/1909 | Garretson |
| 1,205,769 | A | 11/1916 | McGill |
| 1,384,582 | A | 7/1921 | Wills |
| 1,541,211 | A | 6/1925 | Ford |
| 1,789,232 | A | 1/1931 | Hertz |
| 1,939,504 | A | 12/1933 | Lee |
| 2,046,207 | A | 6/1936 | Parsons |
| 2,208,715 | A | 7/1940 | Yochem |
| 2,550,355 | A | 4/1951 | James |
| 2,910,207 | A | 10/1959 | Andrew |

(Continued)

FOREIGN PATENT DOCUMENTS

DE 19540610 A1 5/1997

(Continued)

OTHER PUBLICATIONS

International Search Report PCT/EP01/13000.

*Primary Examiner* — Jennifer E. Novosad
(74) *Attorney, Agent, or Firm* — James E. Howard; Andre Pallapies

(57) ABSTRACT

An insert having insert compartments separated from one another by separating walls with at least two insert compartments provided with compartment floors, arranged in different heights, for loading different silverware pieces and/or small dishes. The silverware pieces and/or the small dishes may, depending on their respective length/size/shape, be loaded into the insert compartment having the corresponding compartment floor positioned in a suitable height, so that they stand on the compartment floor and are no longer required to be hung.

17 Claims, 3 Drawing Sheets

U.S. PATENT DOCUMENTS

| | | | | | |
|---|---|---|---|---|---|
| 3,025,967 | A | | 3/1962 | Christophersen | |
| 3,027,041 | A | | 3/1962 | Stansbury, Jr. et al. | |
| 3,083,836 | A | | 4/1963 | Bussemer | |
| 3,164,108 | A | | 1/1965 | Romero | |
| D213,130 | S | | 1/1969 | Keen et al. | |
| 4,053,954 | A | | 10/1977 | Chapman | |
| 4,369,887 | A | | 1/1983 | Emery | |
| 4,498,594 | A | | 2/1985 | Elder | |
| 4,534,474 | A | | 8/1985 | Ng | |
| 4,889,254 | A | * | 12/1989 | Vola | 220/23.4 |
| 5,123,582 | A | * | 6/1992 | Lo | 225/25 |
| 5,431,294 | A | * | 7/1995 | Stottmann et al. | 220/23.4 |
| 5,865,325 | A | | 2/1999 | Comstock | |
| 6,161,718 | A | * | 12/2000 | Monbo | 220/486 |
| 6,543,069 | B1 | | 4/2003 | Nelson | |
| 6,599,482 | B1 | | 7/2003 | Dorin et al. | |
| 6,945,421 | B2 | * | 9/2005 | Phifer | 220/486 |
| 6,991,106 | B2 | * | 1/2006 | Milliorn | 206/409 |

FOREIGN PATENT DOCUMENTS

| | | | |
|---|---|---|---|
| DE | 19540611 | A1 | 5/1997 |
| DE | 29701078 | U1 | 5/1998 |
| EP | 0914801 | B1 | 9/2005 |
| GB | 2198032 | A | 6/1988 |
| GB | 2303055 | A | 2/1997 |

* cited by examiner

INSERT FOR A DISH BASKET FOR AN AUTOMATIC DISHWASHER

CROSS-REFERENCE OF RELATED APPLICATIONS

This application is a continuation, under 35 U.S.C. §120, of U.S. application Ser. No. 10/437,548, filed May 13, 2003, which was a continuation, under 35 U.S.C. §120, of International Application No. PCT/EP01/13000, filed Nov. 9, 2001, which designated the United States; this application also claims the priority, under 35 U.S.C. §119, of German patent application No. 100 56 488.7, filed Nov. 15, 2000.

BACKGROUND OF THE INVENTION

The invention relates to an insert for a dish basket of an automatic dishwasher.

From the German patent DE 36 41 020 an insert for a dish basket in an automatic dish washer is known for cleaning and drying silverware pieces and small dishes. Here, at least one dish basket is provided with a silverware basket, that can be inserted therein, having openings for the penetration of dish washing liquid in the floor of the silverware basket and the walls of the silverware basket, respectively. The insert is provided with several insert compartments separated from one another by dividing walls. Additionally, a tray may be inserted into the basket floor of the dish basket, having additional openings for silverware pieces to be hung and/or fasteners and/or retainers for small dishes, or may be loaded into the dish basket in a lid-like fashion.

The dish basket known has an even usable height throughout in spite of the differently big and/or long silverware pieces. Some silverware pieces stand in the inserted compartments, others, particularly small parts, are hanging from the openings of the tray. The hanging ones, and the contacting silverware pieces as well, are critical regarding the run-off of drops of dish washing liquid, developing drying spots at those points of the silverware pieces, at which they contact the insert.

In the German publication 195 40 610 and 195 40 611, trays, also called etageres, for dish baskets in an automatic dish washer are described, which may be mounted firmly to the dish basket and/or arranged loosely respectively, being inserts for cleaning and drying of silverware pieces and/or small dishes.

BRIEF SUMMARY OF THE INVENTION

The invention is based on the object to provide an insert of the type described, by which an improved drying result can be achieved compared to conventional solutions.

This object is attained according to the invention by the characteristics of claim 1. Further embodiments of the invention are mentioned in the dependent claims.

Based on an insert having insert compartments separated from one another by dividing walls, at least two insert compartments are provided according to the invention with compartment floors arranged at different levels for loading different silverware pieces and/or small dishes. Overall, compared to conventional solutions, the insert embodied according to the invention results in an essentially improved drying result for the silverware pieces and/or small dishes placed into the insert. The silverware pieces and/or the small dishes may be placed, depending on their respective length/size/shape, into the insert compartment with the corresponding compartment floor having the suitable height such that they stand on the compartment floor and are no longer required to hang. The run-off of drops of dish washing liquid is enhanced, which otherwise lead to the undesired drying spots. The hanging, particularly of the small pieces into a cover, causing the run-off problems mentioned for the drops, is eliminated by the insert compartments having compartment floors of different levels. The improved drying is also beneficial for the cleaning performance of a rinsing and drying program of an automatic dish washer.

According to a particularly beneficial embodiment of the invention the height of the compartment floors is adjustable to the length and/or the size of the silverware pieces and/or the small dishes. This results, depending on requirements, in sections, partially adjusted in their useful height, which can be combined for a variably adjustable insert for most different silverware pieces and/or small dishes.

According to an advantageous variant, the insert compartments form a silverware basket provided with a compartment floor having various usable heights provided by the floors of the silverware basket.

BRIEF DESCRIPTION OF THE DRAWINGS

The invention will now be explained in greater detail with reference to an arrangement for executing the method of the present invention illustrated in the figures of the drawings, in which.

DETAILED DESCRIPTION OF EXEMPLARY EMBODIMENTS OF THE PRESENT INVENTION

Figure 1:
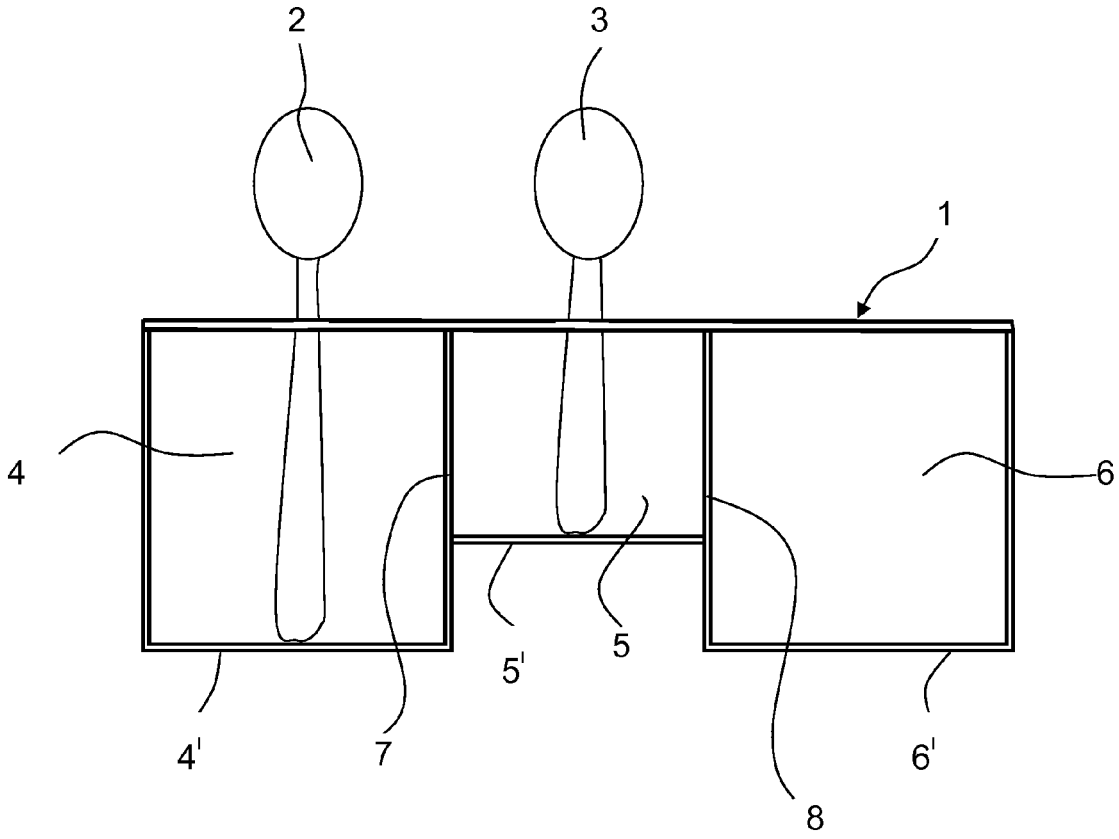
FIG. 1 is a front plan view, in partial section, of one variation of the silverware basket of the present invention.

The object of the invention is explained in greater detail using an exemplary embodiment shown in the FIG. 1, which represents a very simplified side view of a insert, sufficient for the representation of the principle of the invention, though, having several insert compartments embodied according to the invention. In the exemplary embodiment, the insert is embodied as a silverware basket 1 for being loaded with silverware pieces and/or small dishes, in the example selected using spoons 2 and 3 having different lengths and/or size. This silverware basket 1 may be loosely arranged in a dish basket in an automatic dish washer or may be mounted to it firmly or movably. The elementary structure of this silverware basket 1 having side walls, a floor and/or a cover is equivalent to the insert described in the German patent DE 36 41 020.

Figure 2:
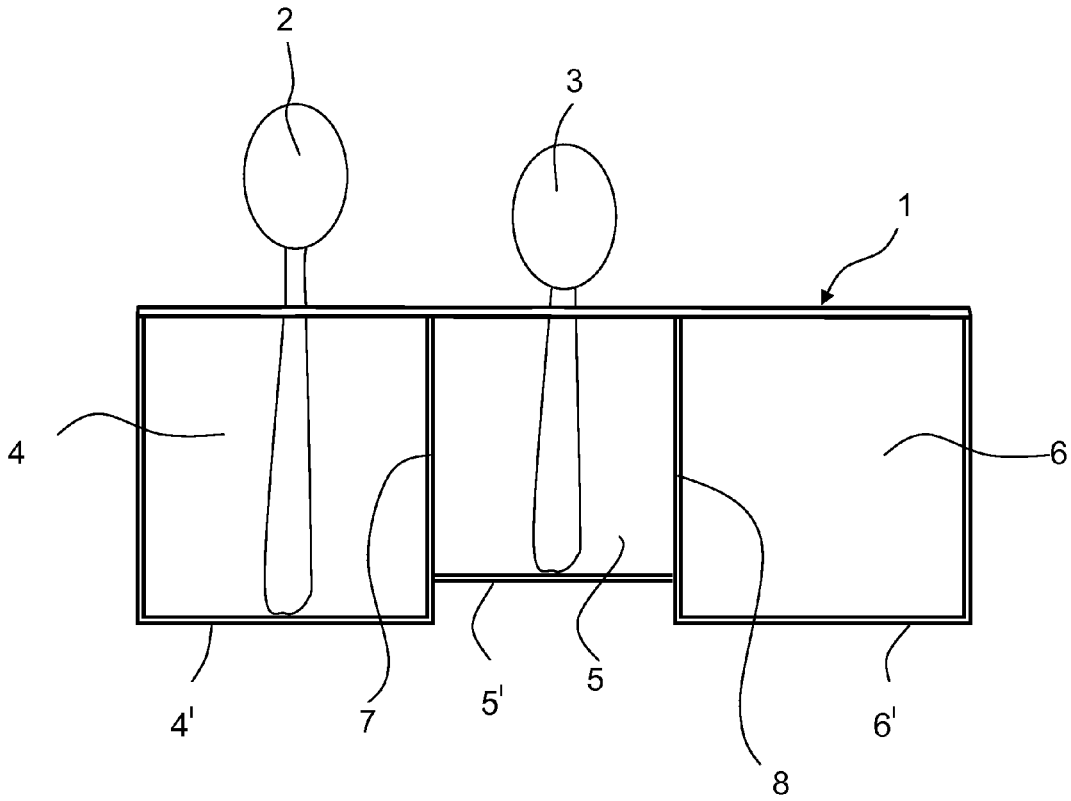
FIG. 2 is a front plan view, in partial section, of another variation of the silverware basket of the present invention.

FIG. 2 illustrates another variation of the silverware basket 1 wherein the silverware basket 1 comprises a total of three insert compartments 4, 5, 6, separated from one another by two vertically extending dividing walls 7 and 8. The insert compartments 4 and 4, 5, and 6 are provided respectively with compartment floors 4', 5', and 6' being arranged at different levels. The short spoon 3, as shown, is loaded into the insert compartment 5 with the corresponding compartment floor 5' so that short spoon 3 stands securely on the compartment floor 5'. The compartment floor 5' of the insert compartment 5 has been lowered relative to the compartment floor 5' of the insert compartment 5 of the one variation of the silverware basket 1 illustrated in FIG. 1, whereupon the height of the corresponding compartment floor 5' of the insert compartment 5 of the variation of the silverware basket 1 illustrated in FIG. 2 is lower than the height of the corresponding compartment floor 5' of the insert compartment 5 of the variation of the silverware basket 1 illustrated in FIG. 1.

Figure 3:
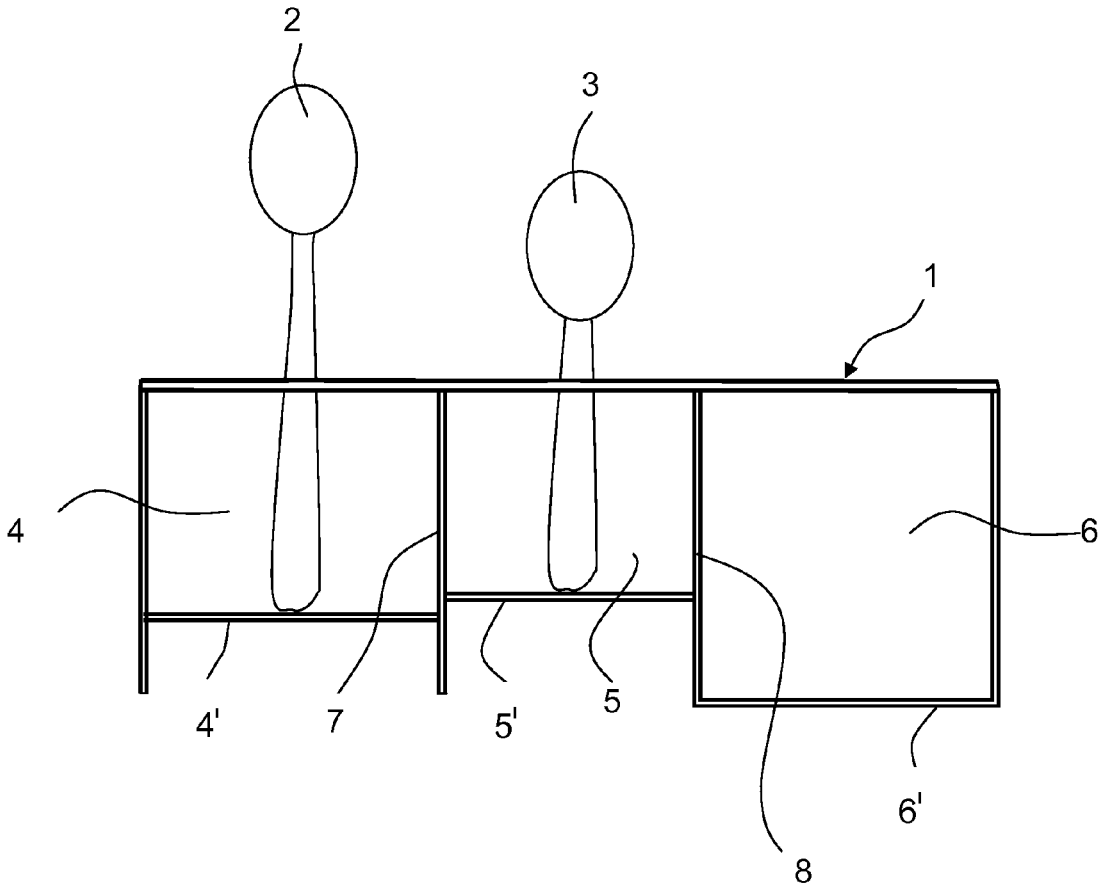
FIG. 3 is a front plan view, in partial section, of a further variation of the silverware basket of the present invention.

FIG. 3 illustrates a further variation of the silverware basket 1 wherein the silverware basket 1 comprises a total of three insert compartments 4, 5, 6, separated from one another by two vertically extending dividing walls 7 and 8. The insert compartments 4 and 4, 5, and 6 are provided respectively with compartment floors 4', 5', and 6' being arranged at different levels. The long spoon 2, as shown, is loaded into the insert compartment 4 with the corresponding compartment floor 4' so that long spoon 2 stands securely on the compartment floor 4'. The compartment floor 4' of the insert compartment 4 has been raised relative to the compartment floor 4' of the insert compartment 4 of the one variation of the silverware basket 1 illustrated in FIG. 1, whereupon the height of the corresponding compartment floor 4' of the insert compartment 4 of the variation of the silverware basket 1 illustrated in FIG. 3 is higher than the height of the corresponding compartment floor 4' of the insert compartment 4 of the variation of the silverware basket 1 illustrated in FIG. 1.

In the example selected, the silverware basket 1 comprises a total of three insert compartments 4, 5, 6, separated from one another by two vertically extending dividing walls 7 and 8. In principle, the silverware basket may be provided with a different number of compartments, however, at least two separated ones. According to the invention, at least two insert compartments, here, for example, the insert compartments 4 and 5 or 5 and 6 are provided with compartment floors 4' and 5' or 5' and 6' being arranged at different levels. The long spoon 2, as shown, is loaded into the insert compartment 4 with the corresponding compartment floor 4' and the longer usable height, so that it stands securely on the compartment floor 4'. It is also possible to load the spoon 2 into the insert compartment 6, with its compartment floor 6' being positioned at the same level as the compartment floor 4' in the exemplary embodiment shown. On the other hand, the insert compartment 5, positioned in the center of the exemplary embodiment shown, serves for accepting and/or loading the short spoon 3, so that this one as well stands securely on the corresponding compartment floor 5'.

The three insert compartments 4, 5, 6 are preferably provided with compartment floors 4', 5', 6' positioned in different levels, in order to create various usable heights for the silverware basket 1, partially adjustable in the individual sections. Overall, this creates a floor of a silverware basket having different utilization heights by the insert compartment floors 4', 5', 6' of the compartments 4, 5, 6 being individually adjustable in height. This allows a raising or lowering of the floor of the silverware basket in selected sections, in order to optimize the drying result when loading the insert with silverware pieces and/or with small dishes of various length, size, shape, etc., in particular. The improved drying is achieved by the variable embodiment of the insert according to the invention such, that the run-off of the dish washing liquid off a silverware basket having various usable heights is improved. The silverware pieces and/or small dishes in any case resting on the compartment floors 4', 5', 6', dry faster. The rapid and autonomous slippage of the dish washing liquid off the respective insert compartments 4, 5, 6, having a compartment floor 4', 5', 6' suitable height not only optimizes the drying performance, additionally it advantageously improves the cleaning performance of the rinsing and drying program of an automatic dish washer.

What is claimed is:

1. An insert for holding silverware pieces being washed in an automatic dish washer having in a dish basket, the insert comprising:

a first compartment configured to hold a first silverware piece of the silverware pieces, the first compartment having a first floor for supporting the first silverware piece during a washing process in the automatic dishwasher; and a second compartment configured to hold a second silverware piece of the silverware pieces, the second compartment having a second floor for supporting the second silverware piece during the washing process in the automatic dishwasher, the second floor being adjustable in a vertical direction between a first position of the second floor and a second position of the second floor, wherein the second floor does not overlap the first floor when the second floor is in the first position of the second floor, the second floor does not overlap the first floor when the second floor is in the second position of the second floor, the second floor and the first floor are on different planes when the second floor is in the second position of the second floor, and a first single common wall separates the first compartment from the second compartment.

2. The insert as claimed in claim 1, further comprising a third compartment configured to hold a third silverware piece of the silverware pieces, the third compartment having a third floor for supporting the third silverware piece during the washing process in the automatic dishwasher, the third floor being adjustable in the vertical direction between a first position and a second position, wherein the third floor does not overlap the first floor when the third floor is in the first position of the third floor, the third floor does not overlap the second floor when the third floor is in the first position of the third floor the third floor does not overlap the first floor when the third floor is in the second position of the third floor, the third floor does not overlap the second floor when the third floor is in the second position of the third floor, the third floor and the first floor are on different planes when the third floor is in the second position of the third floor, and a second single common wall separates the third compartment from the second compartment.

3. The insert as claimed in claim 2, wherein the second floor is parallel to the first floor when the second floor is in the first position of the second floor, the second floor is parallel to the first floor when the second floor is in the second position of the second floor, the third floor is parallel to the first floor when the third floor is in the first position of the third floor, and the third floor is parallel to the first floor when the third floor is in the second position of the third floor.

4. The insert as claimed in claim 1, wherein the second floor is parallel to the first floor when the second floor is in the first position of the second floor, and the second floor is parallel to the first floor when the second floor is in the second position of the second floor.

5. A dish basket/insert combination to be used in an automatic dishwasher, the combination comprising:

a dish basket configured to be located inside the automatic dishwasher during a washing process of the automatic dishwasher; and an insert for holding silverware pieces being washed in the automatic dishwasher during the washing process, the insert being mounted to the dish basket, the insert comprising:

a first compartment configured to hold a first silverware piece of the silverware pieces, the first compartment having a first floor for supporting the first silverware piece during a washing process in the automatic dishwasher; and a second compartment configured to hold a second silverware piece of the silverware pieces, the second compartment having a second floor for supporting the second silverware piece during the washing process in the automatic dishwasher, the second floor being adjustable in a vertical direction between a first position of the second floor and a second position of the second floor, wherein the second floor does not overlap the first floor when the second floor is in the first position of the second floor, the second floor does not overlap the first floor when the second floor is in the second position of the second floor, the second floor and the first floor are on different planes when the second floor is in the second position of the second floor, and a first single common wall separates the first compartment from the second compartment.

6. The combination as claimed in claim 5, wherein the insert is mounted to the dish basket such that the insert is fixed to the dish basket.

7. The combination as claimed in claim 5, wherein the insert is removably mounted to the dish basket.

8. The combination as claimed in claim 5, wherein the insert is mounted loosely to the dish basket such that the insert can move relative to the dish basket in a limited manner when subjected to an impact.

9. The combination as claimed in claim 5, further comprising a third compartment configured to hold a third silverware piece of the silverware pieces, the third compartment having a third floor for supporting the third silverware piece during the washing process in the automatic dishwasher, the third floor being adjustable in the vertical direction between a first position and a second position, wherein the third floor does not overlap the first floor when the third floor is in the first position of the third floor, the third floor does not overlap the second floor when the third floor is in the first position of the third floor the third floor does not overlap the first floor when the third floor is in the second position of the third floor, the third floor does not overlap the second floor when the third floor is in the second position of the third floor, the third floor and the first floor are on different planes when the third floor is in the second position of the third floor, and a second single common wall separates the third compartment from the second compartment.

10. The combination as claimed in claim 9, wherein the second floor is parallel to the first floor when the second floor is in the first position of the second floor, the second floor is parallel to the first floor when the second floor is in the second position of the second floor, the third floor is parallel to the first floor when the third floor is in the first position of the third floor, and the third floor is parallel to the first floor when the third floor is in the second position of the third floor.

11. The combination as claimed in claim 5, wherein the second floor is parallel to the first floor when the second floor is in the first position of the second floor, and the second floor is parallel to the first floor when the second floor is in the second position of the second floor.

12. An automatic dishwasher, comprising:

a dish basket located inside the automatic dishwasher during a washing process of the automatic dishwasher; and an insert for holding silverware pieces being washed in the automatic dishwasher during the washing process, the insert being mounted to the dish basket, the insert comprising:

a first compartment configured to hold a first silverware piece of the silverware pieces, the first compartment having a first floor for supporting the first silverware piece during a washing process in the automatic dishwasher; and a second compartment configured to hold a second silverware piece of the silverware pieces, the second compartment having a second floor for supporting the second silverware piece during the washing process in the automatic dishwasher, the second floor being adjustable in a vertical direction between a first position of the second floor and a second position of the second floor, wherein the second floor does not overlap the first floor when the second floor is in the first position of the second floor, the second floor does not overlap the first floor when the second floor is in the second position of the second floor, the second floor and the first floor are on different planes when the second floor is in the second position of the second floor, and a first single common wall separates the first compartment from the second compartment.

13. The automatic dishwasher as claimed in claim 12, wherein the insert is removably mounted to the dish basket.

14. The automatic dishwasher as claimed in claim 12, wherein the insert is mounted loosely to the dish basket such that the insert can move relative to the dish basket in a limited manner when subjected to an impact.

15. The automatic dishwasher as claimed in claim 12, further comprising a third compartment configured to hold a third silverware piece of the silverware pieces, the third compartment having a third floor for supporting the third silverware piece during the washing process in the automatic dishwasher, the third floor being adjustable in the vertical direction between a first position and a second position, wherein the third floor does not overlap the first floor when the third floor is in the first position of the third floor, the third floor does not overlap the second floor when the third floor is in the first position of the third floor the third floor does not overlap the first floor when the third floor is in the second position of the third floor, the third floor does not overlap the second floor when the third floor is in the second position of the third floor, the third floor and the first floor are on different planes when the third floor is in the second position of the third floor, and a second single common wall separates the third compartment from the second compartment.

16. The automatic dishwasher as claimed in claim 15, wherein the second floor is parallel to the first floor when the second floor is in the first position of the second floor, the second floor is parallel to the first floor when the second floor is in the second position of the second floor, the third floor is parallel to the first floor when the third floor is in the first position of the third floor, and the third floor is parallel to the first floor when the third floor is in the second position of the third floor.

17. The automatic dishwasher as claimed in claim 12, wherein the second floor is parallel to the first floor when the second floor is in the first position of the second floor, and the second floor is parallel to the first floor when the second floor is in the second position of the second floor.

* * * * *